United States Patent [19]

Tacchini

[11] 4,423,672

[45] Jan. 3, 1984

[54] DEVICE FOR FEEDING AND TENSIONING THE PACKAGING STRAP IN STRAP APPLYING MACHINES

[75] Inventor: Franco Tacchini, Milan, Italy

[73] Assignee: Officina Meccanica Sestese S.p.A., Paruzzaro, Italy

[21] Appl. No.: 358,802

[22] Filed: Mar. 16, 1982

[30] Foreign Application Priority Data

Mar. 24, 1981 [IT] Italy ..... 20695 A/81

[51] Int. Cl.[3] ..... B65B 13/22

[52] U.S. Cl. ..... 100/4; 100/32

[58] Field of Search ..... 100/4, 26, 29, 32

[56] References Cited

U.S. PATENT DOCUMENTS 4,011,807 3/1977 Kobiella ..... 100/32 X

FOREIGN PATENT DOCUMENTS 2059010 4/1981 United Kingdom ..... 100/32

*Primary Examiner*—Billy J. Wilhite

*Attorney, Agent, or Firm*—Young & Thompson

[57] ABSTRACT

The invention relates to a device for feeding and tensioning the strap in strap applying machines, of the type in which the strap (R) is moved forward and fed between a pair of wheels, one being a drawing wheel (1) rotated by motor means and the other being an idly rotating contrast wheel (2) pressed against the first wheel through the strap (R). The drawing wheel (1) is caused to rotate by an epicyclic train, the free element (9) of which is connected by a mechanical drive to the shaft (8) of the contrast wheel (2), while the contrast wheel (2) is mounted idle onto an eccentric pin (7) of said shaft (8). The mechanical drive comprises a movable control element (17) being apt to act elastically on the shaft (8) of the contrast wheel (2) in order to cause the rotation thereof.

8 Claims, 2 Drawing Figures

DEVICE FOR FEEDING AND TENSIONING THE PACKAGING STRAP IN STRAP APPLYING MACHINES

BACKGROUND OF THE INVENTION

The present invention relates to improvements in the devices for feeding and tensioning the packaging strap in strap applying machines, that is, in machines designed to draw a strap from a reel, to launch said strap into appropriate guides around the product being strapped, to grip the terminal of the strap thus launched, to recover the launched strap up to wrapping the product therewith, to tension the strap thus arranged around the product up to the pre-established tensioning value, and to cut the strap after it has been applied.

Machines of this type are already known in technique, but it is also known that, in order to properly satisfy the requirements of performance and of efficiency demanded by the modern packaging techniques, such machines should provide, on one hand, high launching and recovery speeds of the strap and simultaneously guarantee, on the other hand, wide possibilities of tensioning adjustment. Due to the considerable difficulties in satisfying and conciliating these two requirements, the presently known strap applying machines seldom come up—in practise—to the operators' expectations and, in the few cases in which they are apt to satisfy the expected requirements, they turn out to be very complicated and costly. Indeed, in the known machines, a high strap launching speed necessarily determines during recovery of the strap, when contacting the product to be tied up, an impact deriving from the mass of the drawing members, which impact imposes the lowest possible tensioning, thereby limiting the width of tensioning adjustment. Furthermore, in the known machines, the strap tensioning adjustment is performed by fixing a launching time or length, whereby changes in the tensioning—depending on the size and nature of the product being tied up with the strap—are bound to occur.

SUMMARY OF THE INVENTION

The present invention relates to a feeding and tensioning device for strap applying machines, which allows to eliminate the aforementioned drawbacks by adopting original solutions of construction and operation which are apt to undo the dangerous effects of the moving masses.

The device according to the present invention—of the type wherein the strap is moved forward and fed between a pair of wheels, one being a drawing wheel rotated by motor means and the other being an idly rotating contrast wheel pressed against the first wheel through the strap is characterized in that, the drawing wheel is caused to rotate by an epicyclic train the free element of which is connected by a mechanical drive to the shaft of the contrast wheel, while the contrast wheel is mounted idle onto an eccentric pin of said shaft, said mechanical drive comprising a movable control element being apt to act elastically on the shaft of the contrast wheel in order to cause the rotation thereof.

Preferably, said epicyclic train comprises a gear carried by the shaft of the motor means planet wheels meshing with said gear and carried by the drawing wheel, and a crown wheel meshing with said planet wheels, the drawing wheel and the crown wheel being mounted idle onto said shaft or onto an extension thereof.

Preferably, also, the mechanical drive between the epicyclic train and the contrast wheel shaft comprises a gear keyed on said crown wheel and a gear idle on said shaft, a chain between said gears and an electromagnetic clutch between the gear idle on said contrast wheel shaft and the shaft itself, said chain comprising a control element apt to compress a spring against a square arm of the contrast wheel shaft. A stop is also provided to fix an end position for the control element, and this latter is apt to engage in appropriate positions a microswitch for stopping the drawing wheel.

BRIEF DESCRIPTION OF THE DRAWINGS

The invention will now be described in further detail, with reference to a preferred embodiment thereof, illustrated by way of example in the accompanying drawings, in which.

DESCRIPTION OF THE PREFERRED EMBODIMENTS

Figure 1:
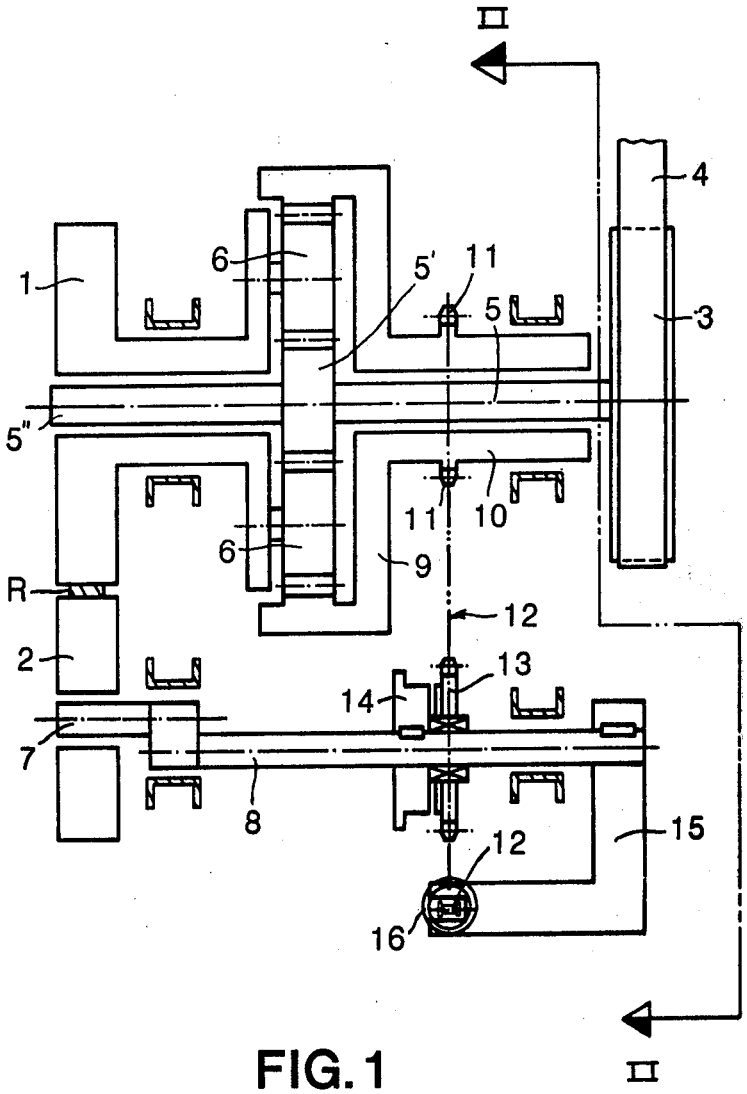
FIG. 1 is a plan section view of the device according to the invention.

As shown in the drawings, the device according to the invention provides for the strap R to be moved forward and fed (FIG. 1) between a drawing wheel 1 and a contrast wheel 2.

The motion of the drawing wheel 1 is obtained, by way of a motor not shown, through a pulley 3 operated by a belt 4 and an epicyclic train connected to the shaft 5 of the pulley 3 and comprising a gear 5' with which mesh planet wheels 6 carried by the drawing wheel 1, this latter being mounted idle onto an extension 5'' of the shaft 5.

The contrast wheel 2 is in turn mounted idle onto an eccentric pin 7 of a shaft 8, so as to be able to impart a pressure onto the strap R against the drawing wheel 1, when suitably rotating said shaft 8.

To complete the epicyclic train of the device, the internal gear 9' of a bell 9, acting as crown wheel, meshes externally with the planet wheels 6. Onto the hollow shaft 10 of said crown wheel, having the same ax s of the wheel 1 and of the gear 5' and idly rotating on the shaft 5, there is keyed a gear 11.

Figure 2:
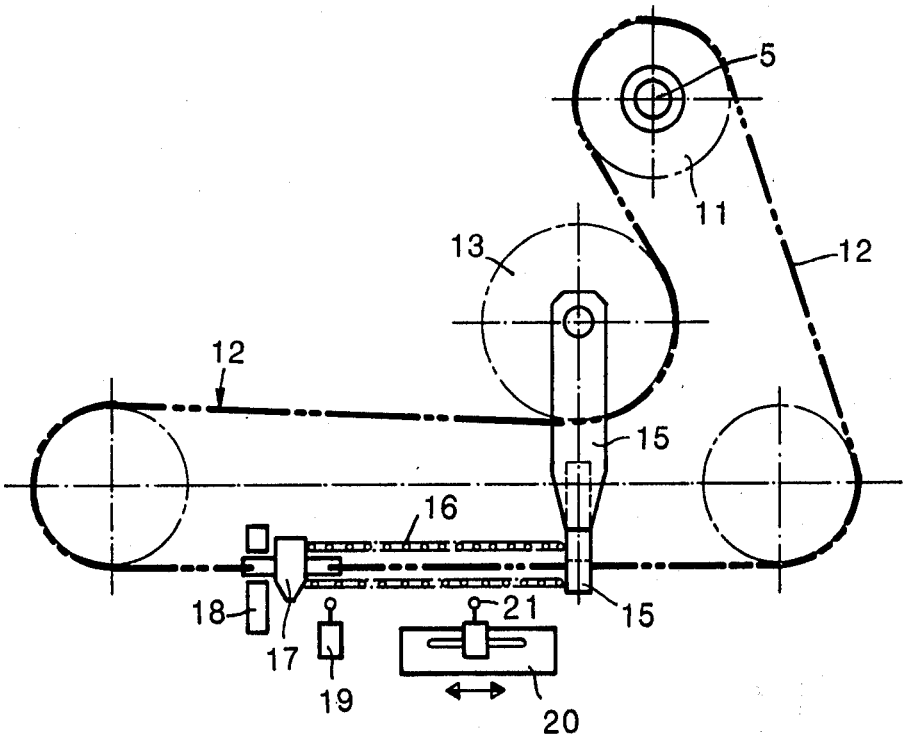
FIG. 2 is a section of the said device, along the line II—II of FIG. 1.

By means of a chain 12, the path of which is shown in FIG. 2, said gear 11 is apt to transmit its own rotation to a gear 13, mounted idle on the shaft 8 of the wheel 2, but apt to be coupled to said shaft 8 for rotation therewith thanks to the action of an electromagnetic clutch 14. Besides the clutch 14, the shaft 8 carries, keyed onto an end thereof, also a square arm or lever 15, which is urged by a spring 16 loaded by the same chain which connects the gears 11 and 13 by means of a control element 17. The control element 17 may be shifted by the motion of the chain 12 towards the arm 15, against the action of the spring 16, but it can perform no movements in the opposite sense—and with it the chain 12—beyond the limit fixed by a stop 18 (FIG. 2).

The device is completed by two microswitches 19 and 20, with which the control element 17 is apt to get engaged when moving with the chain 12 in order to load or unload the spring 16. The microswitch 19 controls the operation of the clutch 14. The microswitch 20 controls the stopping of the wheel 1. The position of the member 21 controlling the microswitch 20 is adjustable along the direction of movement of the control element 17.

In operation, the first step is the launching phase, wherein the pulley 3 causes the advancement and feeding of the strap R, without rotation of either the crown wheel 9 or, consequently, the gear 13, which are kept motionless by stopping of the control element 17 against the stop 18, this latter being apt to lock the chain 12 which the crown wheel 9 would otherwise rotate (clockwise in FIG. 2). The next step is the phase in which the terminal of the strap R is gripped, and the following step is the recovery phase.

During this phase, the direction of rotation of the motor is reversed in respect of that of the previous phases: the crown wheel 9 is now inclined, therefore, to rotate the chain 12 in the direction which would lead to compress the spring 16 with the control element 17. At the start of the recovery phase—when the strap has not yet engaged the product to be tied up—the action of the crown wheel is however balanced by the spring 16 and there is no change in respect of the previous phases—as shown in FIG. 2—the control element 17 being close to the stop 18. At the same time, as in the previous phases, the spring 16 imparts onto the lever or arm 15 a pressure (which can be appropriately adjusted by any suitable means) which is apt to press, to an appropriate extent, the contrast wheel 2 against the wheel 1 which draws the strap R, in order to recover said strap R.

When, as the recovery of the strap R carries on, this latter comes in contact with the product to be tied up, and the tensioning phase therefore starts, the resistance opposed by the strap suddenly increases and the crown wheel 9 is no longer in conditions of balance; said crown wheel therefore starts to rotate and moves, through the gear 11, the chain 12, the gear 13 and the coupling 14—which is in operating conditions—also the shaft 8; the wheel, 2 carried by the eccentric pin 7 of the shaft 8, then moves away from the drawing wheel 1, thereby freeing the strap R. At this point, no action is therefore imparted on said strap, deriving from inertia of the rotating masses which had caused its movement, as was instead the case with the arrangements of known technique.

The rotation by reaction of the crown wheel 9 coincides with a shifting of the control element 17 of the chain 12 towards the arm 15 and against the spring 16. Said shifting soon leads the control element 17 to operate the microswitch 19 of the electromagnetic clutch 14 and this latter is stopped from operating.

Accordingly, any further rotation of the crown wheel 9 is no longer transmitted to the shaft 8, which rotates in a direction opposite to the previous one, under the action of the spring 16, drawing once more the wheel 2 near the wheel 1 in order to cause again the forward motion of the strap R. The pressure imparted by the wheel 2 onto the strap R against the wheel 1 now starts to increase, on account of the increasing action of the spring 16—as a result of the shifting of the control element 17—onto the arm 15 and, consequently, onto the shaft 8. The strap R can thus be put under tension in the most efficient manner since, as the pressure to be imparted thereon increases, also the force which holds it between the two wheels 1 and 2 is apt to increase. When the control element 17 starts to operate the adjustable microswitch 20, the motion of the drawing wheel 1 is stopped and the tensioning ceases. The strap applying machine, of which the device according to the invention forms part, thus continues to work by joining and cutting the strap R, finally applied to the product.

Since the position of the member 21 controlling the microswitch 20 is adjustable, it is possible to vary—to an accurate and wide extent—the tensioning of the strap R according to the different requirements of the tying up being performed.

As well as allowing high launching speeds of the strap—since excluding all interference with the inertia effects of the rotating masses which cause its advancement—and allowing an extensive adjustment of the tensioning—thanks to the aforedescribed mechanism which characterizes it—the arrangement according to the invention also allows to use, in the launching phase and in the strap recovery phase, a coupling pressure between the wheels 1 and 2 which is well below those normally used, while making it possible to increase said pressure even considerably in the tensioning phase, as seen hereabove. This allows to reduce the deformation of the strap R, or to obtain the transversal settlement thereof, with obvious advantages in respect of the safety of the strapping and the possibility to use more economical types of straps for the same packagings.

The presence of the electromagnetic clutch 14 is meant to prevent an exceedingly sudden increase of the strap tension, when said strap comes in contact with the product being tied up at particularly high speeds. It is thus understood that when, viceversa, the speeds at which the strap contacts the product to be tied are modest or anyhow not high, the device according to the invention may even be deprived of the clutch 14 and of the microswitch 19. In this case, it is evident that the gear 13 will always be free to idly rotate on the shaft 8.

It is understood that the invention could also be realized in a different way from that heretofore described and diagrammatically illustrated in the accompanying drawings, without thereby departing from the scope of the invention itself.

I claim:

1. Device for feeding and tensioning the strap in strap applying machines, of the type in which the strap is moved forward and fed between a pair of wheels, one being a drawing wheel rotated by motor means and the other being an idly rotating contrast wheel pressed against the first wheel through the strap, characterized in that the drawing wheel (1) is caused to rotate by an epicyclic train the free element (9) of which is connected by a mechanical drive (11, 12, 17, 16, 15) to the shaft (8) of the contrast wheel (2), while the contrast wheel (2) is mounted idle onto an eccentric pin (7) of said shaft (8), said mechanical drive (11, 12, 17, 16, 15) comprising a movable control element (17) being apt to act elastically on the shaft (8) of the contrast wheel (2) in order to cause the rotation thereof.

2. Device as in claim 1, wherein said epicyclic train comprises a gear (5') carried by the shaft (5) of the motor means, planet wheels (6) meshing with said gear (5') and carried by the drawing wheel (1), and a crown wheel (9) meshing with said planet wheels (6), the drawing wheel (1) and the crown wheel (9) being mounted idle onto said shaft (5) or onto an extension (5'') thereof.

3. Device as in claim 1, wherein the mechanical drive between the epicyclic train and the shaft (8) of the contrast wheel (2) comprises a gear (11) keyed on said crown wheel (9) and a gear (13) idle on said shaft (8), a chain (12) between said gears and an electromagnetic clutch (14) between the gear (13) idle on said contrast wheel shaft (8) and the shaft itself, said chain (12) comprising a control element (17) apt to compress a spring (16) against a square arm (15) of the shaft (8) of the contrast wheel (2).

4. Device as in claim 3, wherein the gear (13) idle on the shaft (8) may be caused to rotate together with said shaft (8) by means of an electromagnetic clutch (14) controlled by a microswitch (19) onto which acts the control element (17).

5. Device as in claim 1, wherein the mechanical drive between the epicyclic train and the shaft (8) of the contrast wheel (2) comprises a gear (11) keyed on said crown wheel (9) and a gear (13) idle on said shaft (8), a chain (12) between said gears and an electromagnetic clutch (14) between the gear (13) idle on said contrast wheel shaft (8) and the shaft itself, said chain (12) comprising a control element (17) apt to compress a spring (16) against a square arm (15) of the shaft (8) of the contrast wheel (2) and wherein a stop (18) fixes an end position for the control element (17) and this latter is apt to cooperate, in a suitable position, with adjustable means (20) apt to control the stopping of the drawing wheel (1).

6. Device as in claim 5, wherein said means for controlling the stopping of the drawing wheel (1) consist of a microswitch (20).

7. Device as in claim 6, wherein the microswitch (20) controlling the stopping of the drawing wheel (1) has a control member (21), the position of which can be widely adjusted in the direction of movement of the said control element (17).

8. Device as in claim 1, wherein the free element (9) of the epicyclic train is a crown wheel formed by the internal gear of a bell mounted idly rotating on the shaft (5) of the motor means.

* * * * *